US010099187B2

(12) United States Patent
Dayton

(10) Patent No.: US 10,099,187 B2
(45) Date of Patent: Oct. 16, 2018

(54) MIXING SYSTEMS AND METHODS

(71) Applicant: ADIP Management, LLC, Draper, UT (US)

(72) Inventor: Angela Peterson Dayton, Draper, UT (US)

(73) Assignee: ADIP MANAGEMENT, LLC, Draper, UT (US)

( * ) Notice: Subject to any disclaimer, the term of this patent is extended or adjusted under 35 U.S.C. 154(b) by 381 days.

(21) Appl. No.: 14/847,963

(22) Filed: Sep. 8, 2015

(65) Prior Publication Data

US 2017/0065943 A1 Mar. 9, 2017

(51) Int. Cl.
*B01F 13/00* (2006.01)

(52) U.S. Cl.
CPC ..... *B01F 13/0022* (2013.01); *B01F 13/0055* (2013.01); *B01F 2215/0022* (2013.01); *B01F 2215/0032* (2013.01)

(58) Field of Classification Search
CPC ..... B01F 13/0022; B01F 13/0055; B01F 13/005; B01F 13/0052; B01F 13/0054; B01F 13/0057; B01F 15/00766; A47G 19/2266
USPC .. 366/129–130, 248, 293, 312, 316, 325.93, 366/330.3–330.5, 330.7
See application file for complete search history.

(56) References Cited

U.S. PATENT DOCUMENTS 826,839 A * 7/1906 Fay ..... A47J 43/044 261/32
835,352 A * 11/1906 Fay ..... A47J 43/044 261/32
2,587,127 A * 2/1952 Erickson ..... A23G 9/20 366/144

(Continued)

FOREIGN PATENT DOCUMENTS

EP 914197 B1 5/2001
EP 2771253 A1 9/2014

(Continued)

OTHER PUBLICATIONS https://www.kickstarter.com/projects/956156534/titan-mixer-bottle-worlds-most-revolutionary-mixer/description, (video content believed to have been posted before Sep. 8, 2015).

*Primary Examiner* — Abbas Rashid
(74) *Attorney, Agent, or Firm* — David Meibos; Maywood IP Law

(57) ABSTRACT

A mixing system and method may be used to facilitate mixture of ingredients within a container such as a bottle for baby formula, fitness drinks, medicines, food substances, art materials, and/or the like. The mixing system may include a mixing apparatus with a container engagement component that couples the mixing system to the container, and a mixing component that mixes the ingredients. The mixing component may have a plurality of mixing surfaces arranged to contact the ingredients in a manner that facilitates mixture of the ingredients together, in response to motion of the (Continued)

container. Alternatively, the container engagement component may be omitted. In either case, each of the mixing members may have one or more windows that facilitate mixture of the ingredients passing there through. Two or more mixing members may be connected together via a shaft and may rotate or otherwise move relative to each other on the shaft.

14 Claims, 10 Drawing Sheets

(56) References Cited

U.S. PATENT DOCUMENTS 2,688,992 A * 9/1954 Russo ..... A47J 43/145 241/46.17
2,887,305 A * 5/1959 Van Ginneken ..... B01F 7/16 366/142
3,920,226 A * 11/1975 Walt ..... A47J 43/27 206/219
3,993,290 A * 11/1976 Kovich ..... A47G 19/18 366/130
4,818,114 A 4/1989 Ghavi
5,199,788 A * 4/1993 Stallings ..... B01F 7/1695 366/247
5,368,389 A 11/1994 Dedoes
5,433,328 A 7/1995 Baron
5,638,968 A 6/1997 Baron
5,664,883 A * 9/1997 Tomassini ..... B01F 7/00283 366/325.93
5,794,802 A 8/1998 Caola
5,865,539 A * 2/1999 Rogers ..... B01F 7/00583 366/129
5,984,518 A * 11/1999 King ..... B01F 7/1625 366/129
6,045,254 A 4/2000 Inbar
6,062,721 A * 5/2000 King ..... B01F 7/1625 366/129
6,079,405 A 6/2000 Justo
6,132,080 A * 10/2000 Gurth ..... B01F 7/00241 366/286
6,241,381 B1 * 6/2001 Noda ..... B01F 3/0478 366/262
6,257,428 B1 7/2001 Caola
6,325,532 B1 * 12/2001 King ..... B01F 7/00241 366/129
6,379,032 B1 4/2002 Sorensen
6,616,319 B2 9/2003 Renz
7,036,975 B2 5/2006 Renz
7,168,849 B2 * 1/2007 Adams ..... B01F 7/00633 366/270
7,513,678 B2 * 4/2009 Venus ..... B01F 7/001 366/129
7,810,661 B2 10/2010 Murphy
8,033,713 B2 10/2011 Lion
8,167,175 B2 5/2012 Jaouen
8,313,228 B2 11/2012 Reay
8,371,440 B2 2/2013 Questad
8,413,803 B2 4/2013 Questad
8,534,908 B2 9/2013 Rhodes, II
8,939,305 B2 1/2015 Meyers
D723,325 S 3/2015 Enghard
9,204,759 B2 * 12/2015 Stewart ..... B01F 13/0022
9,301,648 B2 * 4/2016 Aliberti ..... A47J 43/27
2003/0218935 A1 11/2003 Hu
2004/0013030 A1 1/2004 Renz
2004/0047231 A1 * 3/2004 Coll ..... A47J 43/27 366/130
2005/0105387 A1 5/2005 Nikkhah
2006/0187750 A1 * 8/2006 Aldrich ..... B01F 7/0015 366/270
2008/0156763 A1 7/2008 Murphy
2008/0259723 A1 10/2008 Rhodes
2010/0302897 A1 12/2010 George et al.
2011/0011819 A1 1/2011 Lee
2011/0024464 A1 2/2011 Jaouen
2012/0318765 A1 12/2012 Questad
2012/0318766 A1 12/2012 Questad
2013/0010568 A1 1/2013 Bodum
2013/0201783 A1 * 8/2013 Stewart ..... B01F 13/0022 366/130
2013/0201784 A1 * 8/2013 Hauser ..... B01F 13/0022 366/130
2013/0341297 A1 12/2013 Stephan
2013/0343148 A1 * 12/2013 Avila ..... B01F 13/005 366/130
2014/0119154 A1 5/2014 Kershaw
2014/0140163 A1 5/2014 Reay
2014/0192610 A1 7/2014 Holmes
2015/0290605 A1 10/2015 Dayton
2015/0374175 A1 * 12/2015 Garr ..... A47J 43/27 366/130
2016/0184785 A9 * 6/2016 Kershaw ..... B01F 13/0022 366/130
2016/0192810 A1 * 7/2016 Knapp ..... A47J 43/27 366/343
2016/0227960 A1 * 8/2016 DellaContrada .... A47J 31/4496
2016/0288068 A1 * 10/2016 Connealy ..... B01F 15/00512

FOREIGN PATENT DOCUMENTS

WO WO1997007724 A1 3/1977
WO WO2005011934 A2 2/2005
WO WO2014056079 A1 4/2014
WO WO2015157549 10/2015

* cited by examiner

MIXING SYSTEMS AND METHODS

TECHNICAL FIELD

The present invention relates to systems and methods for mixing ingredients. More specifically, the present invention relates to whisk systems to be retained in various containers to facilitate mixture of ingredients of the container.

BACKGROUND

There are many circumstances in which disparate ingredients are to be mixed together within a container. For example, various drinks, such as hot chocolate, baby formula, protein and nutritional supplements, and the like are made by mixing a powder with a liquid such as water. Further, some medicines, such as antacids, antibiotics, and the like are rendered in drinkable form by mixing a powder, gel, solid, or other soluble material with water or other liquids.

Unfortunately, existing mixing systems and methods tend to leave some ingredients unmixed. It is not uncommon, for example, to find clumps of undissolved formula in a baby bottle, even after vigorous shaking. The same can be said of many other mixing processes. The result is that the desired ratio of ingredients is not obtained, and some ingredients are wasted. Further, the process of cleaning a container after incomplete mixing can be somewhat more difficult.

SUMMARY OF THE INVENTION

The various systems and methods of the present invention have been developed in response to the present state of the art, and in particular, in response to the problems and needs in the art that have not yet been fully solved by currently available mixing systems and methods. The systems and methods of the present invention may provide mixing systems that provide more rapid and complete mixing, less unmixed residue, and/or an overall more enjoyable experience.

To achieve the foregoing, and in accordance with the invention as embodied and broadly described herein, enhanced mixing systems and methods may be provided for mixing ingredients in a container. Such a mixing system may include, in one embodiment, a container engagement component and a mixing component. The container engagement component may have one or more container engagement surfaces positioned to engage an interior of the container to keep the mixing system in place relative to the container. The mixing component may be coupled to the container engagement component, and may include a shaft extending along an axis, and a plurality of mixing members arranged along the shaft. Each of the mixing members may have a plurality of mixing surfaces. The mixing members may be rotatably coupled to the shaft such that the mixing members are rotatable about the axis in response to repetitive motion of the container with the mixing system disposed within the container. This rotation may cause the mixing surfaces to contact the ingredients in a manner that promotes mixture of the ingredients together.

In some embodiments, the mixing members may be fixedly attached to the shaft. The shaft may be manually rotated via actuation of an actuation interface coupled to the shaft. The actuation interface may be accessible through an actuation aperture in a cap portion of the u container so that the user may insert the tip of a finger or thumb through the actuation aperture and into engagement with the actuation interface to cause the shaft to rotate within the container.

In some embodiments, each of the mixing members may have a discoid shape that is radially asymmetrical about the axis. Specifically, each of the mixing members may be asymmetrically weighted such that each of the mixing members has a center of gravity that is displaced from the axis. Further, each of the mixing members may be slidably coupled to the shaft such that the mixing members are movable along the axis in response to motion of the container with the mixing system disposed within the container.

Yet more specifically, in some embodiments, each of the mixing members may have an inner rim that engages the shaft, and first, second, and third vanes that extend outwardly from the inner rim. The first vane may have a first mixing surface of the plurality of mixing surfaces; the first mixing surface may be oriented nonparallel and nonperpendicular to the axis such that motion of the mixing member along the axis, within a fluid of the ingredients, induces rotation of the mixing member about the axis. Each of the mixing members may further have a weight portion extending from a second vane distal end of the second vane to a third vane distal end of the third vane. The weight portion may have a geometry selected to cause the mixing member to be asymmetrically weighted.

Further, in some embodiments, the first mixing surface may be shaped to define a window. The first vane may further have a plurality of bridging members that span the window. Each of the bridging members may have at least one bridging member mixing surface of the plurality of mixing surfaces. The bridging member mixing surfaces may facilitate mixture together of ingredients flowing through the window.

Yet further, in some embodiments, each of the mixing members may also have a fourth vane and a fifth vane extending outward from the inner rim. The fourth vane may have a fourth mixing surface of the plurality of mixing surfaces. Similarly, the fifth vane may have a fifth mixing surface of the plurality of mixing surfaces. The fourth and fifth mixing surface may be oriented nonparallel and nonperpendicular to the axis such that motion of the mixing member along the axis, within a fluid of the ingredients, induces rotation of the mixing member about the axis.

The mixing system may further include the container. The container may be of any known type in which disparate ingredients are mixed. Thus, the container may be a shaker bottle for mixing fitness beverages, a baby bottle for formula or supplements, a bottle containing medication to be mixed, a bottle for mixing spirits, and/or the like.

According to one mixing method, a mixing system with a container engagement component and a mixing component may be used. The method may include inserting the mixing component and the container engagement component into the container. The mixing component may include a shaft extending along an axis, and a plurality of mixing members arranged along the shaft. Each of the mixing members may have a plurality of mixing surfaces. The method may further include engaging an interior of the container with one or more container engagement surfaces of the container engagement component, and with the mixing component disposed within the container, moving the container repetitively to cause the mixing members to rotate about the axis. In response to rotation of the mixing members about the axis, the mixing surfaces may contact the ingredients in a manner that promotes mixture of the ingredients.

In some embodiments, each of the mixing members may have a discoid shape that is radially asymmetrical about the axis. Each of the mixing members may be asymmetrically weighted such that each of the mixing members has a center of gravity that is displaced from the axis. Rotating the mixing members about the axis may cause the center of gravity of each of the mixing members to rotate about the axis.

In some embodiments, each of the mixing members may be slidably coupled to the shaft. The method may further include, in response to repetitive motion of the container, sliding the mixing members along the axis. Moving the container repetitively may cause the container to reciprocate along a direction generally parallel to the axis.

In some embodiments, each of the mixing members may have an inner rim that engages the shaft, and first, second, and third vanes that extend outward from the inner rim. The first vane may have a first mixing surface of the plurality of mixing surfaces. The first mixing surface may be oriented nonparallel and nonperpendicular to the axis such that motion of the mixing member along the axis, within a fluid of the ingredients, induces rotation of the mixing member about the axis. Each of the mixing members may further have a weight portion extending from a second vane distal end of the second vane to a third vane distal end of the third vane. The weight portion may have a geometry selected to cause the mixing member to be asymmetrically weighted. Rotating the mixing members may use the vanes to cause the mixing members to rotate about the axis in response to sliding of the mixing members along the axis. Contacting the ingredients with the mixing surfaces may include causing the first mixing surface to pass through the ingredients in response to rotation of the mixing members.

In some embodiments, the first mixing surface may be shaped to define a window. The first vane may further have a plurality of bridging members that span the window. Each of the bridging members may have at least one bridging member mixing surface of the plurality of mixing surfaces. Contacting the ingredients with the mixing surfaces may include contacting the ingredients with the bridging member mixing surfaces in response to flow of the ingredients through the window.

According to one alternative embodiment, a mixing system for mixing ingredients in a container may include a mixing component positionable within an interior of the container. The mixing component may include a shaft and a plurality of mixing members arranged along and coupled to the shaft. Each of the mixing members may be shaped to define a plurality of mixing surfaces. The plurality of mixing surfaces may include a first mixing surface and a second mixing surface on an opposite side of the mixing member from the first mixing surface. Each of the mixing members may be shaped to define a plurality of windows that extend between the first and second mixing surfaces to permit passage of the ingredients there through between the first and second mixing surfaces. In response to repetitive motion of the container with the mixing system disposed within the container, the mixing surfaces may contact the ingredients in a manner that promotes mixture of the ingredients together.

In some embodiments, for each of the mixing members, the plurality of windows may include a shaft retention window sized to receive the shaft. The shaft may have a plurality of enlarged portions that are spaced apart from each other, and a plurality of narrow segments that are narrower than the enlarged portions. Each of the narrow segments may extend between two of the enlarged portions. The shaft retention window may be larger than the narrow segments and smaller than the enlarged portions. The shaft retention window and the enlarged portions may be dimensioned such that, in response to application of force urging one of the enlarged portions through the shaft retention window, the one of the enlarged portions snaps through the shaft retention window. In some embodiments, for each of the mixing members, the plurality of windows further include a primary window and a secondary window smaller than the primary window.

In some embodiments, each of the mixing members may have a substantially uniform thickness between the first mixing surface and the second mixing surface. The plurality of windows may include a primary window. Each of the mixing members may further include a plurality of bridging members that span the window. Each of the bridging members may have at least one bridging member mixing surface of the plurality of mixing surfaces. The bridging member mixing surfaces may facilitate mixture together of ingredients flowing through the window.

These and other features and advantages of the present invention will become more fully apparent from the following description and appended claims, or may be learned by the practice of the invention as set forth hereinafter.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

DETAILED DESCRIPTION

Exemplary embodiments of the invention will be best understood by reference to the drawings, wherein like parts are designated by like numerals throughout. It will be readily understood that the components of the invention, as generally described and illustrated in the Figures herein, could be arranged and designed in a wide variety of different configurations and made out of any of a wide variety of different materials, such as plastic, silicone, metal, stainless steel, aluminum and the like. Thus, the following more detailed description of the embodiments of the apparatus, system, and method, as represented in FIGS. 1 through 8, is not intended to limit the scope of the invention, as claimed, but is merely representative exemplary of exemplary embodiments of the invention.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other. The term "abutting" refers to items that are in direct physical contact with each other, although the items may not necessarily be attached together. The phrase "fluid communication" refers to two features that are connected such that a fluid within one feature is able to pass into the other feature.

The word "exemplary" is used herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Figure 1:
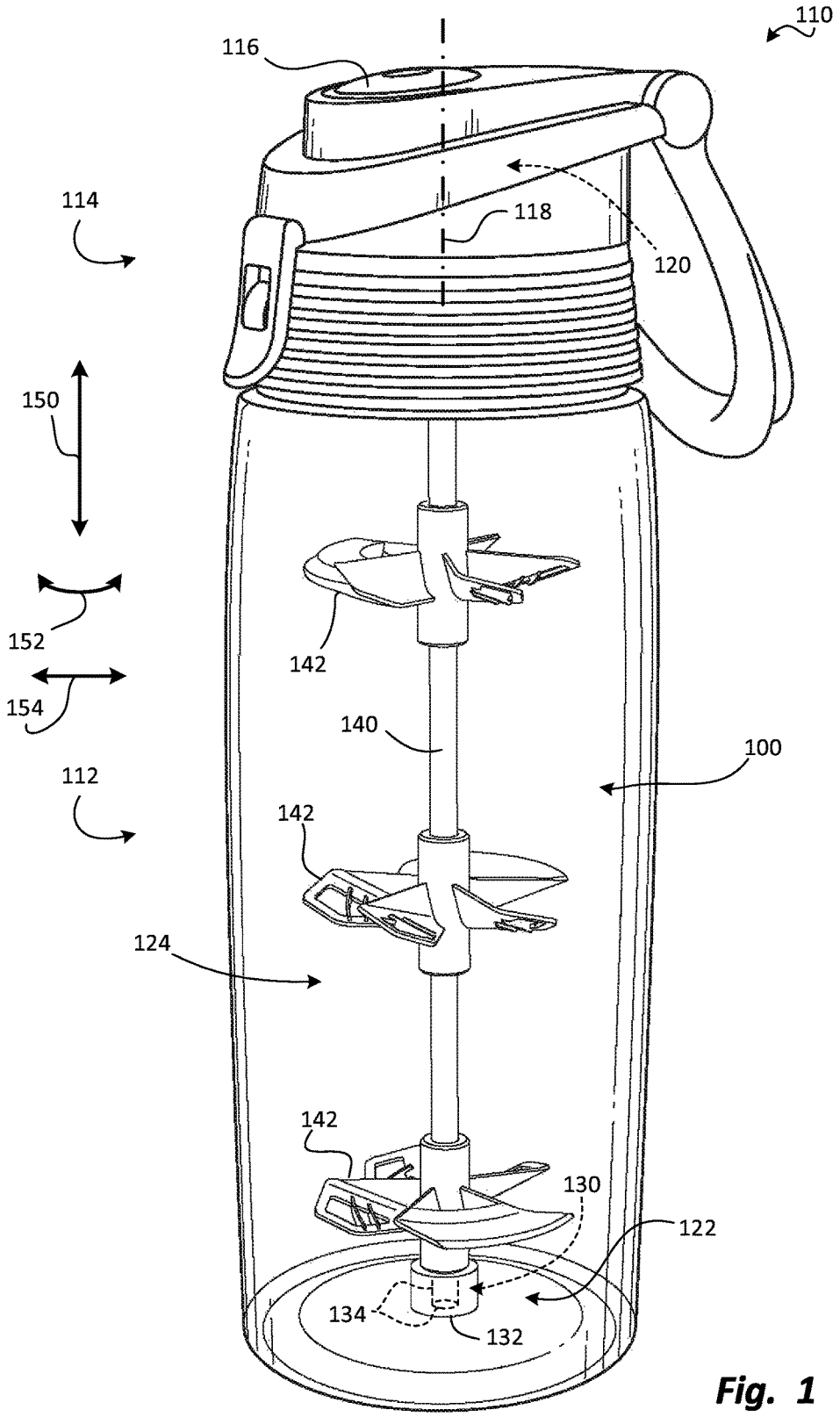
FIG. 1 is a perspective view of a mixing system positioned within a container, according to one embodiment.

Referring to FIG. 1, a perspective view illustrates a mixing system 100 according to u one embodiment of the invention. The mixing system 100 is shown disposed within a container 110. The container 110 of FIG. 1 may be a shaker bottle commonly used for mixing fitness beverages such as protein drinks. However, the container 110 of FIG. 1 is merely exemplary; the various mixing systems and methods of the present disclosure may be used in connection with a wide variety of containers used to mix ingredients together. Such container types may include, but are not limited to, shaker bottles, baby bottles for formula or supplements, bottles containing medication to be mixed, bottles for mixing spirits, and the like.

The mixing system 100 may be designed to be contained entirely within the container 110. The container, in the embodiment of FIG. 1, may have a bottle portion 112 that contains the majority of the ingredients, and a cap portion 114 that provides selective containment and access of the ingredients. The cap portion 114 may have a drinking aperture 116 that may be used to directly imbibe the contents of the container 110. The drinking aperture 116 may be covered with a cover that keeps the ingredients in place within the container 110 when the user is not drinking from the container 110.

The container 110, or at least the bottle portion 112, may have general radial symmetry (but not necessarily complete radial symmetry) about an axis 118. The mixing system 100 may be positioned to extend along the axis 118. Some elements of the mixing system 100 may be radially symmetrical about the axis 118, while others may be made intentionally radially asymmetrical, as will be shown and described subsequently.

The mixing system 100 may have various components that cooperate to facilitate mixture of the ingredients of the container 110. Specifically, the mixing system 100 may have a first container engagement component 120, a second container engagement component 122, and a mixing component 124. The first container engagement component 120 and the second container engagement component 122 may cooperate to keep the mixing system 100 properly positioned and/or oriented within the container 110. The mixing component 124 may facilitate mixture of the ingredients together.

The first container engagement component 120 and the second container engagement component 122 may each retain one end of the mixing component 124. Specifically, the first container engagement component 120, which is not shown in FIG. 1, may couple the mixing component 124 to the cap portion 114 of the container 110. Similarly, the second container engagement component 122, which is visible through the transparent wall of the bottle portion 112, may couple the mixing component 124 to the bottle portion 112 of the container 110.

The first container engagement component 120 and the second container engagement component 122 may each have a cylindrical boss 130, which may be received in a tubular receiver 132 of the corresponding one of the bottle portion 112 and the cap portion 114. Each of the cylindrical bosses 130 may define a plurality of engagement surfaces 134, which may contact the corresponding parts of the container 110 (i.e., the tubular receivers 132) to keep the cylindrical bosses 130 in place, thereby keeping the mixing component 124 in place. The engagement surfaces 134 may include the cylindrical and circular surfaces defined by the generally cylindrical shape of the cylindrical bosses 130. The cylindrical boss 130 with engagement surfaces 134 is shown for the second container engagement component 122; the first container engagement component 120 may have a similar boss with engagement surfaces (not shown), which may be received in and contact a corresponding tubular receiver (not shown) in the cap portion 114 of the container 110.

The first container engagement component 120 and the second container engagement component 122 are merely exemplary. Although the mixing system 100 has two container engagement components, in other embodiments (not shown), only one container engagement component may be used. For example, the first container engagement component 120 or the second container engagement component 122 may be omitted in favor of a single-ended cantilever attachment by which the mixing system 100 is secured only its top end, to the cap portion 114, or at its bottom end, to the bottle portion 112.

Additionally or alternatively, in other embodiments (not shown), either of the first container engagement component 120 and the second container engagement component 122 may be omitted in favor of integration of the mixing system 100 with the bottle portion 112 and/or the cap portion 114 of the container 110. For example, the tubular receiver 132 that receives the boss of the second container engagement component 122 may be omitted, and the cylindrical boss 130 of the second container engagement component 122 may instead be formed as a single piece with the interior of the bottle portion 112 and/or permanently attached (for example, via bonding or welding) to the interior of the bottle portion 112. Additionally or alternatively, the tubular receiver 132 (not shown) of the first container engagement component 120 may be omitted, and the cylindrical boss 130 (not shown) of the first container engagement component 120 may be formed as a single piece with the cap portion 114 and/or permanently attached (for example, via bonding or welding) to the interior of the cap portion 114.

The mixing system 100 and the container 110 may be made specifically to work together (for example, by forming the tubular receivers 132 in the bottle portion 112 and in the cap portion 114 with the appropriate dimensions and spacing to receive the first container engagement component 120 and the second container engagement component 122). In alternative embodiments (not shown), a mixing system may have one or more container engagement components that are made to work with containers that are not specifically designed to receive and/or retain the mixing system. For example, a mixing system may have one or more engagement components that do not rely on specific mixing system engagement features of a container, but rather engage interior surfaces of the container that are present for other purposes, such as containment of the ingredients.

For example, such a container engagement component may engage the container in a variety of ways, including but not limited to mechanical fastening, adhesive or chemical bonding, thermal, friction, inertial, infrared, radio frequency, or other welding, and/or the like. In some embodiments (not shown), a container engagement component may be designed to expand to engage the interior diameter of a tubular or other shape having inwardly-oriented surfaces. Such an engagement component may be able to engage a container at multiple levels of expansion so that the resulting mixing system can be installed and securely retained in containers of a variety of sizes and/or shapes.

By way of further example, an alternative embodiment (not shown) of a mixing system for baby formula may have an expandable container engagement component that expands to engage the interior of the neck of the bottle. Such a mixing system may be usable in conjunction with baby bottles having a variety of neck sizes. The baby bottles may be conventional, and need not have any particular feature to receive and/or engage with the mixing system.

The mixing component 124 may have a shaft 140 and a plurality of mixing members 142. By way of example, the mixing component 124 of FIG. 1 has three mixing member 142. However, in other embodiments, a different number of mixing members may be used, including but not limited to one, two, four, or five, or more mixing members.

The container 110 may be repetitively moved in any of various patterns to cause the mixing component 124 to facilitate mixture of the ingredients together. For example, the user may shake the container by repetitively moving the container 110 back and forth along the axis 118, as represented by the arrows 150. Additionally or alternatively, the user may shake the container 110 by causing the axis 118 of the container 110 to revolve about an arbitrary axis displaced from the axis 118, as indicated by the arrows 152. This motion may be akin to swirling the contents of a glass. Additionally or alternatively, the user may shake the container 110 linearly from side-to-side, as indicated by the arrows 154. The mixing component 124 may be designed such that mixing occurs as a result of any of these motion patterns.

Figure 2:
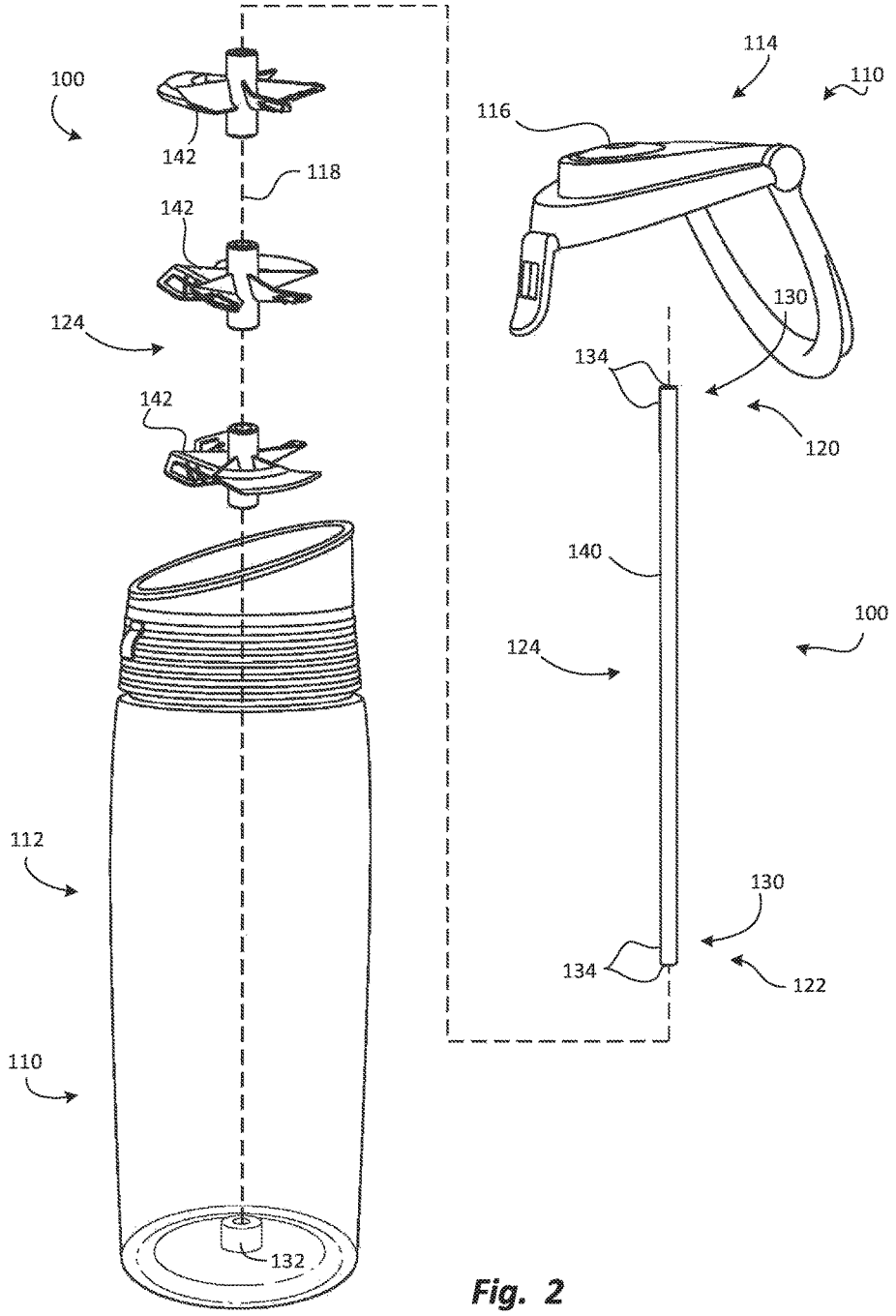
FIG. 2 is an exploded, perspective view of the mixing system and the container of FIG. 1.

FIG. 2 is an exploded, perspective view of the mixing system 100 and the container 110 of FIG. 1. The configuration and assembly of the various components of the mixing system 100 will be described in connection with FIG. 2.

The shaft 140 may have a generally cylindrical shape. The ends of the shaft 140 may define the cylindrical bosses 130 of the first container engagement component 120 and the second container engagement component 122. The shaft 140 may have a length selected to enable the shaft 140 to span the length of the interior of the container 110, from the interior of the bottom surface of the bottle portion 112, to the interior of the top surface of the cap portion 114. When the first container engagement component 120 and the second container engagement component 122 are coupled to the container 110, the shaft 140 may be positioned and oriented such that the axis of symmetry of the shaft 140 is collinear with the axis 118.

Each of the mixing members 142 may be freely slidable along and rotatable about the shaft 140 and the axis 118. The mixing members 142 may be designed to rotate about and/or slide along the axis 118 in response to repetitive motion of the container 110, such as that described previously and represented by the arrows 150 and the arrows 152 of FIG. 1. This motion of the mixing members 142 may cause mixing surfaces on the mixing members 142 to contact the ingredients in the container 110 in a manner that helps mix them together. The configuration and operation of the mixing members 142 will be shown and described in greater detail in connection with FIGS. 3 and 4.

If desired, the mixing system 100 may be sold along with the container 110, or as a separate unit. The shaft 140 and the mixing members 142 may be packaged in disassembled form so that the mixing system 100 occupies relatively little space. The mixing system 100 may then easily be assembled with the container 110. By way of example, this may be commenced by inserting the cylindrical boss 130 of the second container engagement component 122 (i.e., the bottom end of the shaft 140) into the tubular receiver 132 of the bottle portion 112 of the container 110. Then, the cylindrical boss 130 of the first container engagement component 120 (i.e., the top end of the shaft 140) may be inserted through the receiving apertures of each of the mixing members 142 until all of the mixing members 142 are rotatably coupled to the shaft 140. Then, the top end of the shaft 140 may be aligned with the tubular receiver 132 of the cap portion 114 of the container, and the cap portion 114 may be secured to the bottle portion 112 such that the cylindrical boss 130 of the first container engagement component seats within the tubular receiver 132 of the cap portion 114.

Notably, these steps may be carried out in a variety of sequences. For example, the cylindrical boss 130 of the first container engagement component 120 may first be inserted into the tubular receiver 132 of the cap portion 114. Alternatively, the mixing members 142 may first be inserted onto either end or both ends of the shaft 140, and then the first container engagement component 120 and the second container engagement component 122 may be inserted into the tubular receivers 132 of the container 110.

Figure 3:
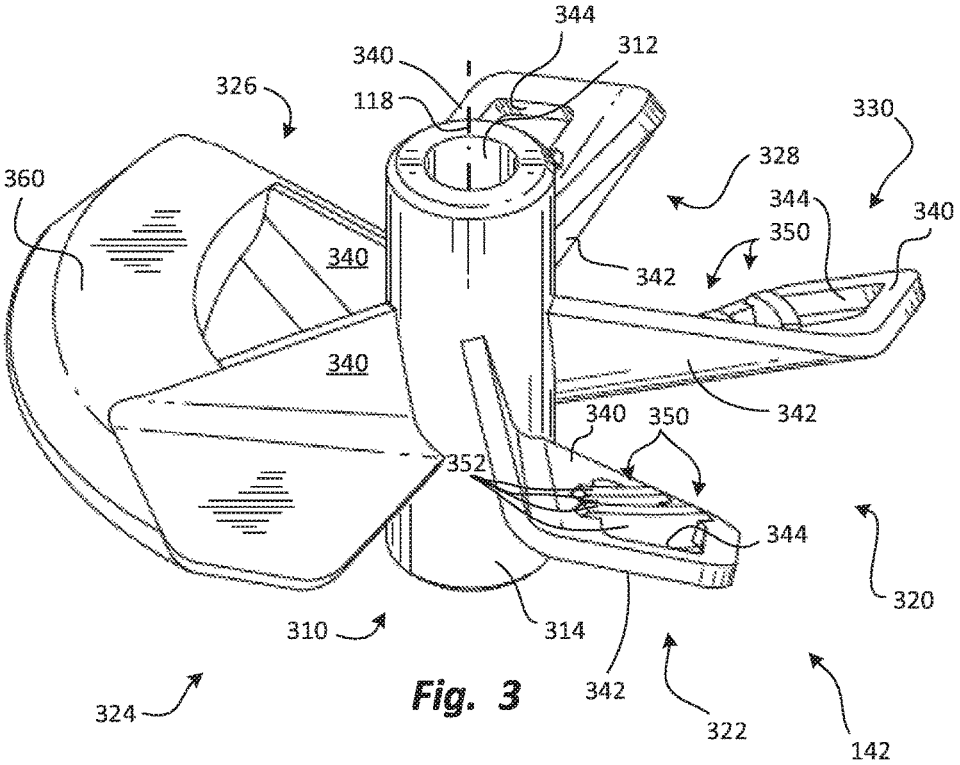
FIG. 3 is a perspective view of a mixing member of the mixing system of FIG. 1, in isolation.
Figure 4:
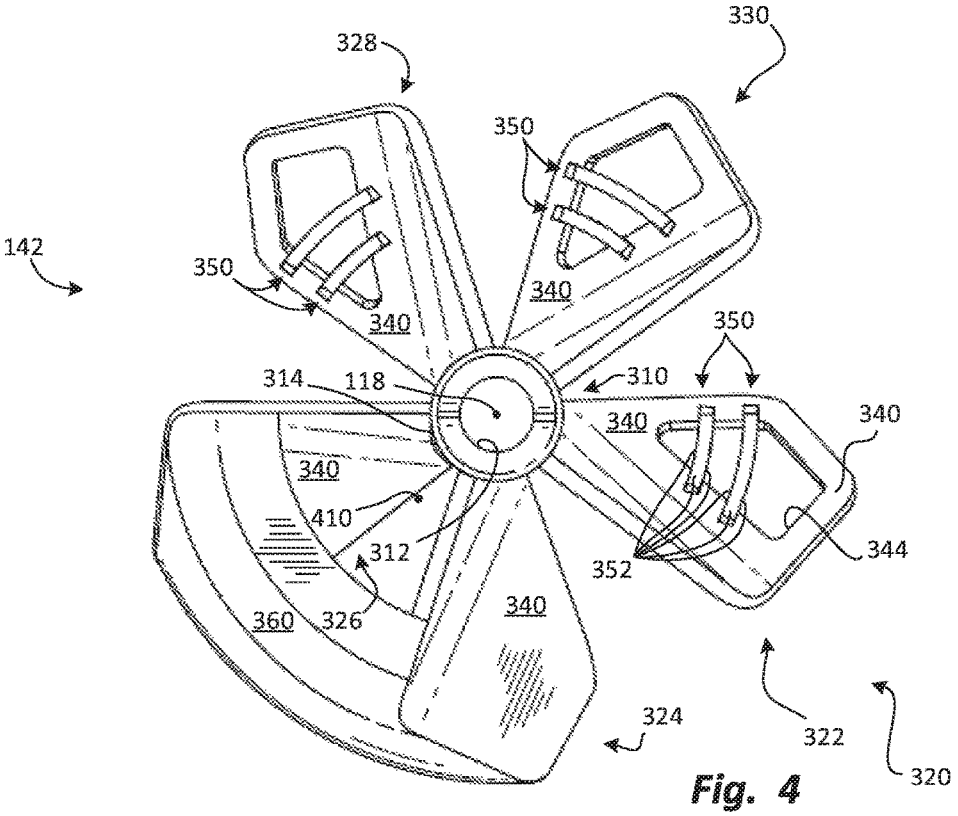
FIG. 4 is a plan view of a mixing member of the mixing system of FIG. 1, in isolation.

FIG. 3 is a perspective view of a mixing member 142 of the mixing system 100 of FIG. 1, in isolation. FIG. 4 is a plan view of a mixing member 142 of the mixing system 100 of FIG. 1, in isolation. The operation of the mixing members 142 will be further described in connection with FIGS. 3 and 4.

Each of the mixing members 142 may have an inner rim 310 with a generally tubular shape or any other shape having an interior surface 312 and an exterior surface 314. The interior surface 312 and the exterior surface 314 may both be generally cylindrical in shape. The interior surface 312 may be relatively smooth to facilitate rotation of the mixing member 142 about the shaft 140 and sliding of the mixing member 142 along the shaft 140. Each of the mixing members 142 may also have a plurality of vanes 320 that extend outward from the inner rim 310. The vanes 320 may generally have the shape of blades of a fan, and may thus cause each mixing member 142 to rotate about the shaft 140 in response to relative motion, parallel to the shaft 140, between the vanes 320 and the ingredients (and in particular, fluid ingredients) of the container 110.

The vanes 320 may include a first vane 322, a second vane 324, a third vane 326, a fourth vane 328, and a fifth vane 330. The vanes 320 may be distributed relatively evenly about the axis of the mixing member 142, or the axis of symmetry of the inner rim 310. Each of the vanes 320 may have a top mixing surface 340 and a bottom mixing surface 342 that faces away from the top mixing surface 340. Notably, the vanes 320 may be shaped such that each mixing member 142 can be installed with the top mixing surface 340 oriented toward the cap portion 114, or with the bottom mixing surface 342 oriented toward the cap portion 114. The operation of each mixing member 142 may be similar in both orientations.

In addition to the top mixing surface 340 and the bottom mixing surface 342, the vanes 320 of the mixing members 142 may be shaped to define additional mixing surfaces. A "mixing surface" is any surface (with any geometry) that contacts the ingredients of the container 110 in a manner that facilitates mixing. Generally, the speed at which the mixing members 142 cause the ingredients to mix may generally be proportional to the relative motion between the mixing members 142 and the ingredients, and to the surface area that is moving relative to the ingredients. The geometry of the mixing surfaces may also help determine the efficiency of mixing. Specifically, the presence of a larger number of mixing surfaces, sharp edges between intersecting mixing surfaces, and/or a larger overall surface area of mixing surfaces, may help to increase fluid shear, thereby expediting mixing.

The vanes 320 of the mixing members 142 may be shaped to promote mixing. Specifically, the top mixing surface 340 and the bottom mixing surface 342 of each of the vanes 320 may be separated from each other by a substantially uniform thickness. Each of the first vane 322, the fourth vane 328, and the fifth vane 330 may be shaped to define a window 344 through which the ingredients of the container 110 can pass. Each window 344, itself, may define mixing surfaces that contact the ingredients to further facilitate mixing.

Additionally, each of the mixing members 142 may have a plurality of bridging members 350 that span each of the windows 344. The bridging members 350 may each have a plurality of bridging member mixing surfaces 352 that further expedite mixing. Specifically, each of the bridging members 350 may have a rectangular cross sectional shape that provides additional edges where the bridging member mixing surfaces 352 intersect each other. These edges may further expedite mixing as the ingredients in the container 110 move through each of the windows 344.

In addition to the inner rim 310 and the vanes 320, each of the mixing members 142 may have a weight portion 360 that extends between the distal ends of the second vane 324 and the third vane 326. The weight portion 360 may be integrally formed with the second vane 324 and the third vane 326, if desired. The weight portion 360 may have a geometry selected such that the weight portion 360 has significant mass. The mass of the weight portion 360 may cause the mixing member 142 to have a center of gravity 410 that is significantly offset from the axis 118, as shown by way of example in FIG. 4. This eccentric weighting may enhance rotation of the mixing members 142 about the axis 118 in response to repetitive motion of container 110 described above, as represented by the arrows 152 and the arrows 154.

Further, the eccentric weighting (and the overall weight of the mixing members 142) may cause the mixing members 142 to rotate, in response to the repetitive motion, with force sufficient to overcome the effects of fluid drag that will be induced by motion of the mixing members 142 through the ingredients. Thus, the mixing members 142 may be well-suited to the mixture of relatively viscous ingredients. If desired, the mixing members 142 may be made of a relatively dense material such as a metal to enhance their mass, and thence, their angular momentum. Conversely, the shaft 140 may be formed of a lighter, less expensive material such as a plastic.

The configuration of the mixing members 142 of FIGS. 3 and 4 is merely exemplary. In alternative embodiments (not shown), mixing members of a wide variety of shapes and sizes may be used. For example, in some embodiments, the mixing members may be formed of alternative materials such as plastics, ceramics, and composite materials.

Further, in some embodiments (not shown), mixing members may have different geometries. For example, a different number of vanes may be used, such as one, two, three, four, six, seven, eight, nine, or ten. Windows of varying number and shape may be used; for example, each vane may have multiple windows. Windows may optionally be formed in vanes that connect to one or more weight portions. Each window may be spanned by any number of bridging members, including but not limited to zero, one, three, four, and five bridging members. Yet further, intersecting bridging members may be used, such as lattice structures and the like. Bridging members may have a wide variety of cross sectional shapes besides the rectangular cross sectional shape mentioned previously.

In alternative embodiments (not shown), various weight portion configurations may be used. If desired, a weight portion may be coupled to only one vane, or to three or more of the vanes. In the alternative to using an integrated weight portion, a weight portion may be formed separately from the vanes and attached to one or more of the vanes, for example, via fastening, bonding, welding, or the like. As another example, one or more vanes may be made heavier than the others, for example, by making them thicker, longer, and/or wider than the other vanes. Such heavier vanes may function in place of a discrete weight portion by providing eccentric weighting.

Further, in alternative embodiments (not shown), the mixing members 142 may not be freely slidable along the shaft 140. Rather, the mixing members 142 may be rotatable about the shaft 140, but fixed to specific positions on the shaft 140. This may be accomplished through the use of registration features such as ridges and grooves formed in the interior surface 312 of the inner rim 310 and/or in the exterior of the shaft 140. By way of example, such registration features may snap into engagement with each other when the mixing members 142 are pushed to the proper locations on the shaft 140 so that the mixing members 142 stay at their desired locations on the shaft 140. Thus, in fully-assembled form, the mixing members may remain spaced apart as shown in FIG. 1, rather than falling to the bottom of the bottle portion 112 of the container 110.

Yet further, in alternative embodiments (not shown), the mixing members 142 may be slidable along the shaft 140, but may be spaced apart from each other so that the mixing members maintain a desired minimum spacing between them. This may be accomplished through the use of inner rims with elongated shapes that provide the desired spacing, or the like.

Still further, in alternative embodiments (not shown), it may be desirable to have one or more of the mixing members rotate along a direction different from the rotation directions of other mixing members. For example, where there are three mixing members, the mixing member in the middle may have vanes that are oriented so that the middle mixing member rotates in a direction opposite to that of the mixing members above and/or below it. Such differential rotation may increase fluid shear, thereby expediting mixing. Those of skill in the art will recognize that a wide variety of alternative embodiments besides those specifically enumerated herein, may be effected with the aid of the present disclosure.

In still other alternative embodiments, a mixing system according to the present disclosure need not be coupled to a container, and need not have elements that are designed to accomplish mixing via relative rotation or translation. Some examples of such embodiments will be shown and described in connection with FIGS. 5 through 8, as follows.

Figure 5:
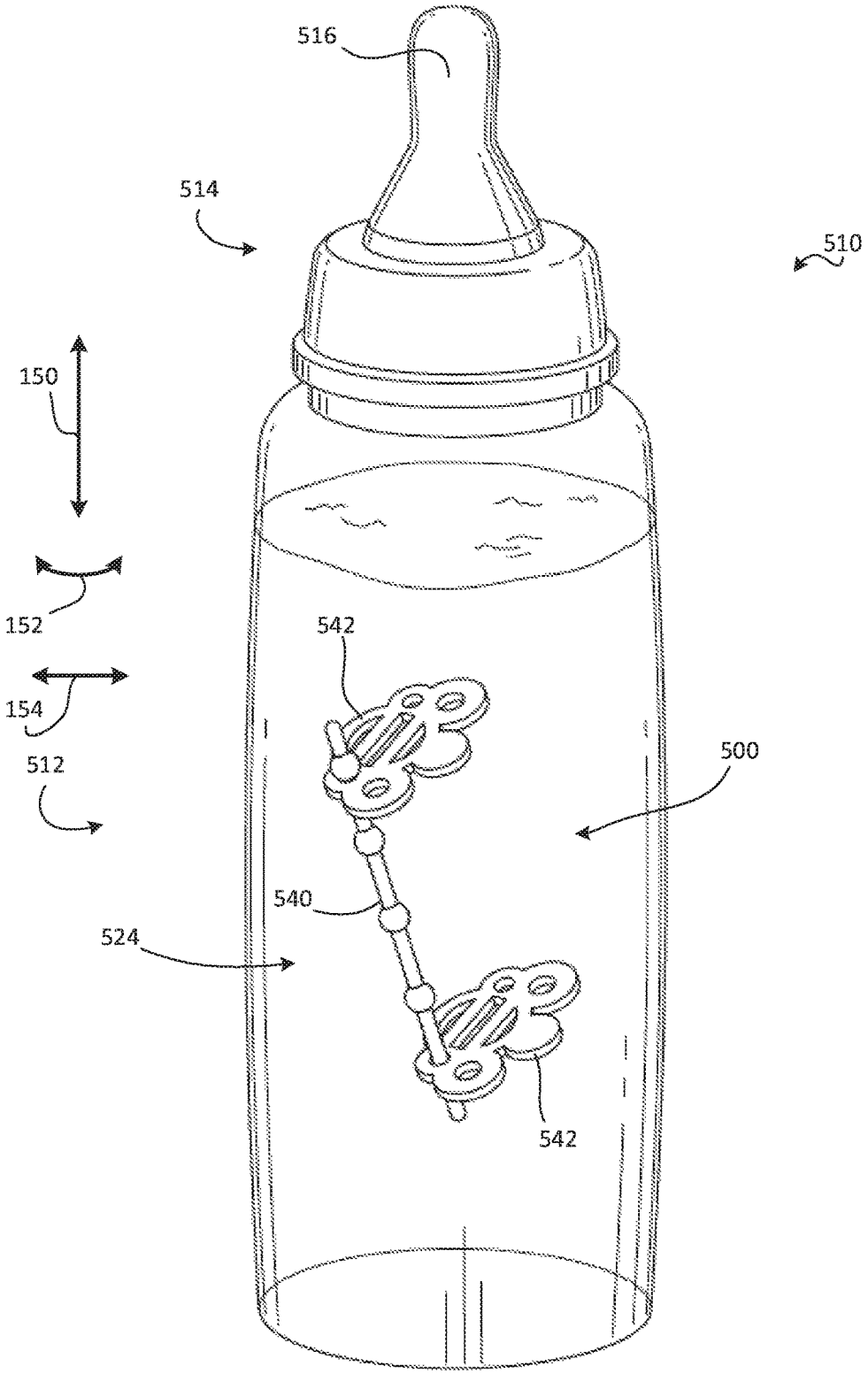
FIG. 5 is a perspective view of a mixing system positioned within a container, according to one alternative embodiment.

FIG. 5 is a perspective view of a mixing system 500 positioned within a container 510, according to one alternative embodiment. The mixing system 500 may not be coupled to the container 510, and thus may not require any particular type of container. The container 510 shown in FIG. 5 is a baby bottle of a type commonly used for mixing and feeding formula for infants. However, the mixing system 500 may be used in connection with any type of container in which disparate ingredients are mixed, including but not limited to those listed previously.

The container 510, by way of example, may have a bottle portion 512 that contains most of the ingredients, and a cap portion 514 that retains the ingredients. The cap portion 514 may have a nipple 516 that facilitates feeding the mixed ingredients to an infant. The mixing system 500 may be sized such that the mixing system 500 can be inserted into the bottle portion 512 with the cap portion 514 removed. Like the mixing system 100 of FIGS. 1 through 4, the mixing system 500 may be designed to facilitate mixture of the ingredients within the container 510 in response to a variety of repetitive motion patterns, including but not limited to those described in connection with the mixing system 100, and represented by the arrows 150, the arrows 152, and the arrows 154.

The mixing system 500 may have a mixing component 524 designed to facilitate mixture of the ingredients within the container 510. The mixing system 500 may not have a container engagement component, but may rather reside unrestrained within the container 510. The mixing component 524 may be designed to sink, float, or reside with substantially neutral buoyancy within the ingredients in the container 510. It may be desirable for one or more elements of the mixing component 524 to be formed of a relatively dense material, such as a metal or ceramic or a dense plastic, to enable enhanced relative motion between the mixing component 524 and the ingredients in response to the repetitive motion. In alternative embodiments, if desired, the mixing component 524 may be fixedly, rotatably, and/or slidably coupled to the container 510 via a shaft or other coupling member (not shown).

The mixing component 524 may have various components. As embodied in FIG. 5, the mixing component 524 may have a shaft 540 and a plurality of mixing members 542. By way of example, the mixing component 524 may have two mixing members 542, as illustrated. Notably, the shaft 540 need not necessarily be rigid; the shaft 540 may be formed of a material selected to permit significant flexure of the shaft 540. If desired, the shaft 540 may even be a line, such as a woven cord, or the like. The configuration and operation of the shaft 540 and the mixing members 542 will be shown and described in connection with FIG. 6.

Figure 6:
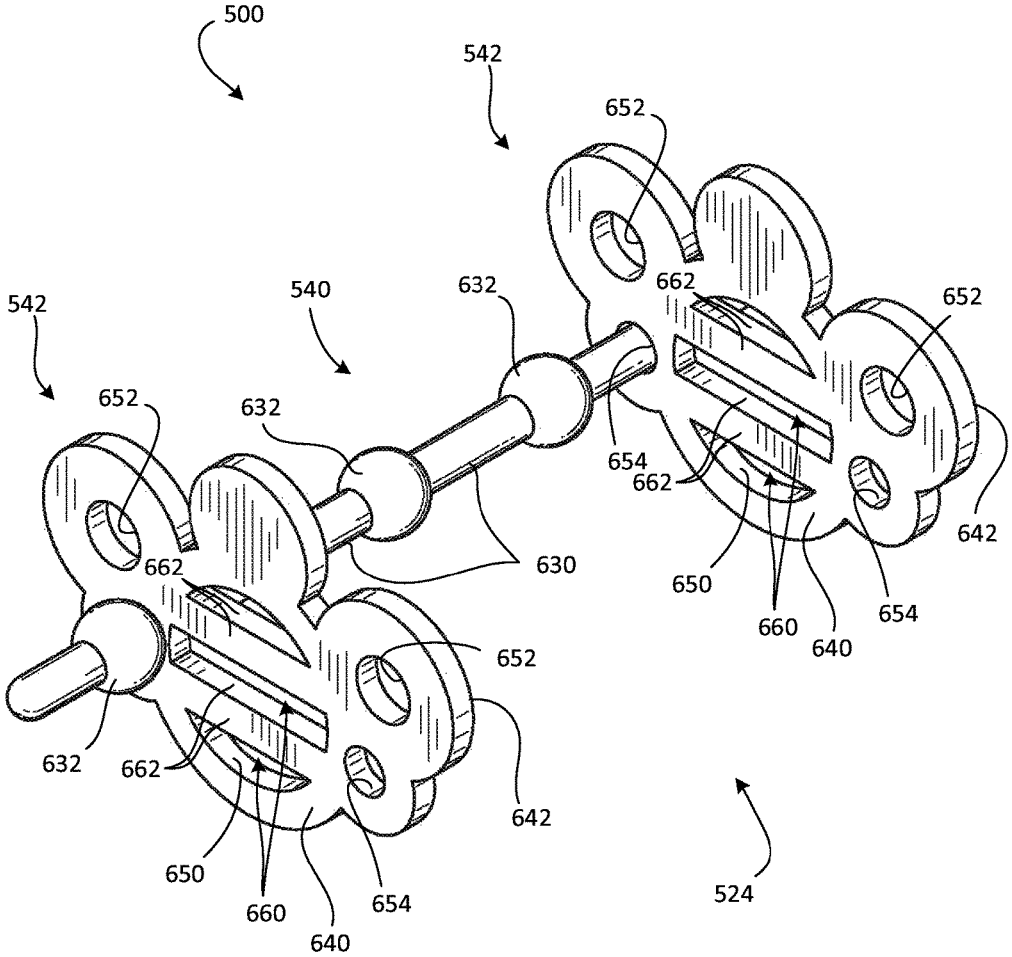
FIG. 6 is a perspective view of the mixing system of FIG. 5, in isolation.

FIG. 6 is a perspective view of the mixing system 500 of FIG. 5, in isolation. As shown, the shaft 540 may have a plurality of narrow segments 630 that are separated from each other by a plurality of enlarged portions 632. The narrow segments 630 may provide multiple spaced apart positions at which the mixing members 542 may be retained on the shaft 540.

The narrow segments 630 and the enlarged portions 632 may have substantially circular cross sections as shown. In alternative embodiments, a variety of flat-sided, rounded, and/or combined flat-sided and rounded cross-sectional shapes may be used, including but not limited to polygonal shapes, circular shapes, sectorial shapes, oval shapes, elliptical shapes, and the like. Further, as shown, the enlarged portions 632 may be generally spherical in shape. In alternative embodiments, the enlarged portions 632 may have other shapes, which may include flat-sided, rounded, and/or combined flat-sided and rounded three-dimensional shapes.

Each of the mixing members 542 may have a relatively thin, flat shape of constant thickness that defines a first mixing surface 640 and a second mixing surface 642 on the opposite side of the mixing members 542 from the first mixing surface 640. The first mixing surface 640 and the second mixing surface 642 may each have an ornamental shape such as a bumblebee shape, as shown in FIG. 6. The first mixing surface 640 and the second mixing surface 642 may advantageously have complex shapes with various edges and/or protuberances that help to expedite mixture of the ingredients.

Further, the mixing members 542 may each have a plurality of windows that further facilitate mixing of the ingredients. As discussed in connection with the mixing system 100 of FIGS. 1 through 4, a window may increase the number of edges and/or the overall surface area of a mixing member, thereby improving its mixing efficiency. By way of example, the mixing members 542 of FIG. 6 may each have a primary window 650 proximate its center, a pair of secondary windows 652 proximate its periphery, and a pair of shaft retention windows 654 that are also positioned proximate its periphery.

The primary window 650, the secondary windows 652, and the shaft retention windows 654 may have any of a variety of shapes, including but not limited to any of the flat-sided, curved, and combined shapes mentioned previously. In the exemplary embodiment of FIG. 6, the primary window 650, the secondary windows 652, and the shaft retention windows 654 may each have a generally circular shape. The shaft retention windows 654 may advantageously have a shape similar to that of the cross-sectional shapes of the narrow segments 630 and the enlarged portions 632 of the shaft 540.

Each of the shaft retention windows 654 may have a size that is larger than the cross-sectional shapes of the narrow segments 630, and smaller than the cross-sectional shapes of the enlarged portions 632. The relative sizing may be such that the enlarged portions 632 can be urged to "snap" through the shaft retention windows 654 to facilitate assembly of the mixing component 524. Further, the relative sizing may be such that the enlarged portions 632 do not pass through the shaft retention windows 654 during mixing, cleaning, or other activities, i.e., in the absence of force deliberately applied to urge the enlarged portions 632 through the shaft retention windows 654. The generally spherical shapes of the enlarged portions 632 shown in FIG. 6 may help to provide this balance by providing a tapered lead-in that facilitates deformation of the enlarged portions 632 when such force is deliberately applied.

The ability to assemble the mixing component 524 by hand may facilitate manufacture, packaging, shipping, and/or cleaning of the mixing system 500. For example, the mixing members 542 and the shaft 540 may be manufactured separately and packaged in disassembled form. The user may then assemble them together prior to first use, and then insert the mixing component 524 in to the container 510. Cleaning may be accomplished, for example, by pulling the mixing members 542 off of the ends of the shaft 540 to disassemble the mixing component 524 so that the mixing system 500 is more compact and/or easier to wash in a dishwashing machine or the like or the mixing system 500 may stay intact throughout its use and may never be disassembled.

Each of the mixing members 542 may have a plurality of bridging members 660 that span the primary window 650. Like the bridging members 350 of the mixing members 142 of the mixing system 100 of FIGS. 1 through 4, the bridging members 660 may expedite mixture of ingredients flowing through the primary window 650 by providing additional surfaces, edges, and/or surface area in contact with the ingredients. The bridging members 660 may have bridging member mixing surfaces 662 that help to accomplish this. As set forth in the description of the previous embodiment, the number, shape, and arrangement of the bridging members 660 is merely exemplary. In alternative embodiments, different numbers, patterns, and/or shapes of bridging members may be used to facilitate mixing.

The use of two of the mixing members 542 is also merely exemplary. The shaft 540 illustrated in FIG. 6 has multiple narrow segments 630, four of which are positioned between enlarged portions 632, and may therefore serve as locations for retaining mixing members 542. Thus, four of the mixing members 542 could be coupled to the narrow segments 630 without positioning more than one on any of the narrow segments 630. Further, if desired, more than one of the mixing members 542 may be positioned on one or more of the narrow segments 630, enabling the use of more than four of the mixing members 542 without requiring a longer narrow segments 630. Further, the length of the shaft 540, the number of narrow segments 630, and/or the number of enlarged portions 632 may be modified to accommodate more or fewer of the mixing members 542, to provide greater or less spacing between the mixing members 542, and/or to provide for a more or less compact design.

The bumblebee shape of the mixing members 542 of FIG. 6 is merely exemplary. Many other shapes may be used; some additional examples will be shown in connection with FIGS. 7 and 8.

Figure 7:
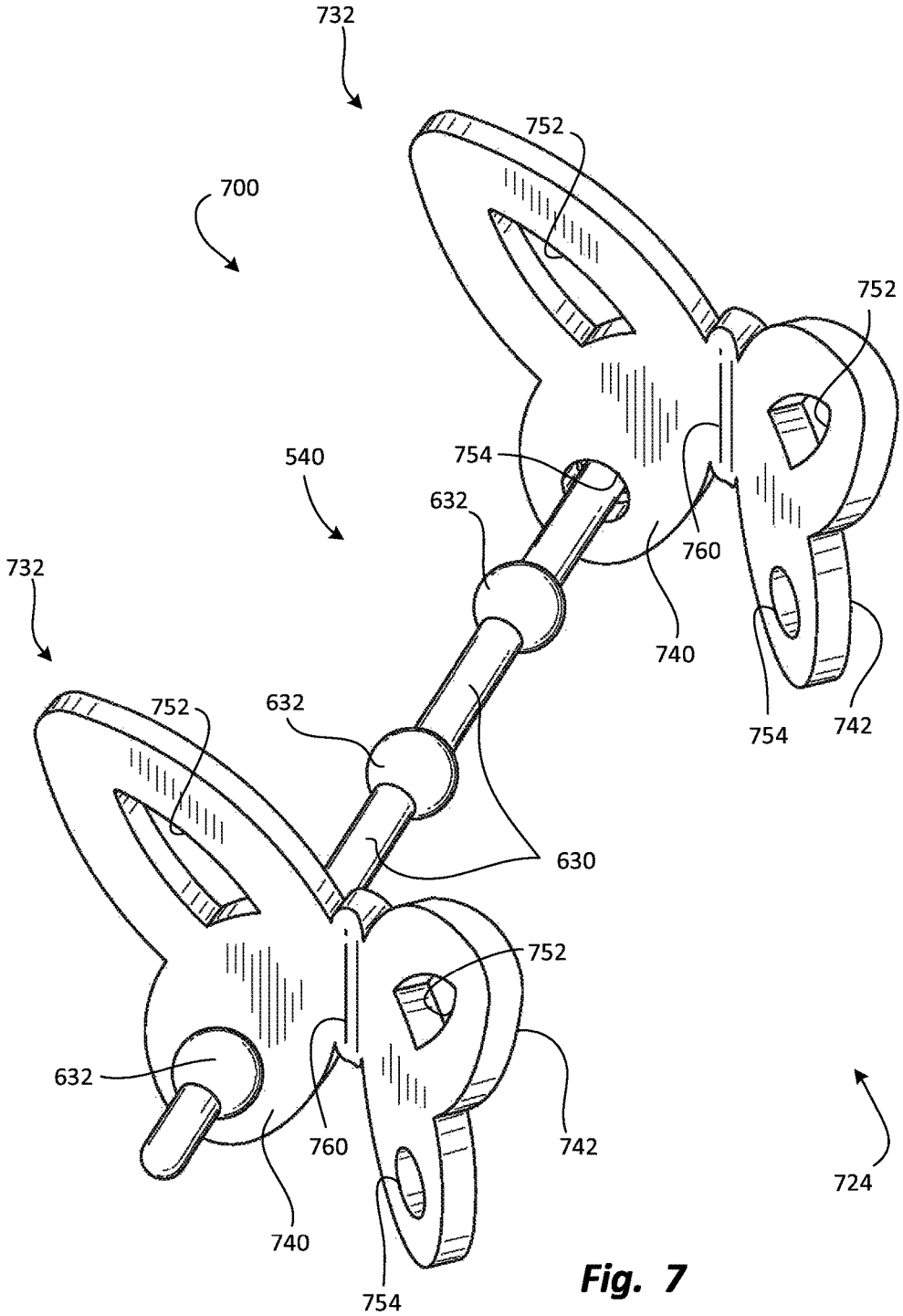
FIG. 7 is a perspective view of a mixing system according to another alternative embodiment.

FIG. 7 is a perspective view of a mixing system 700 according to another alternative embodiment. The mixing system 700 may be used in a manner similar to that of the mixing system 500, and may also be used on conjunction with a wide variety of containers. The mixing system 700 may have a mixing component 724 with a shaft 540 like that of the mixing system 500, and a plurality of mixing members 732.

Each of the mixing members 732 may have a first mixing surface 740 and a second mixing surface 742 positioned on the opposite side of the mixing member 732 from the first mixing surface 740. The first mixing surface 740 and the second mixing surface 742 may have a shape different from the bumblebee shape of the first mixing surface 640 and the second mixing surface 642 of the mixing members 542 of the previous embodiment. Specifically, the first mixing surface 740 and the second mixing surface 742 may each have an ornamental butterfly shape. Again, the various protrusions and edges of the shape may facilitate mixture of the ingredients together.

Each of the mixing members 732 may have a pair of primary windows 752 and a pair of shaft retention windows 754. Each of the primary windows 752 may have a generally triangular shape. The shaft retention windows 754 may be sized, relative to the narrow segments 630 and the enlarged portions 632 of the shaft 540, in a manner that retains the mixing members 732 on the shaft 540, while still allowing relatively easy assembly and disassembly of the mixing component 724.

Each of the mixing members 732 may have a central portion that is substantially free of any window. Further, in contrast to the previous embodiment, the mixing members 732 may function independently of any bridging members that span the primary windows 752 or the shaft retention windows 754.

The mixing members 732 may also have relatively thin shapes with substantially uniform thickness. However, the mixing members 732 may not be flat like the mixing members 542 of the previous embodiment. Rather, each of the mixing members 732 may have a central fold 760 that spans its central region, dividing it into two substantially identical halves. The central fold 760 may have any desired angle, including but not limited to 5°, 10°, 15°, 20°, 25°, 30°, 35°, 40°, and 45°. Larger angles may also be used, if desired. The central fold 760 may make it easier to maintain the surface area of the mixing members 732, while enabling the mixing members 732 to fit through an opening of a specific size, such as the narrow neck of a baby bottle such as the container 510 of FIG. 5.

Figure 8:
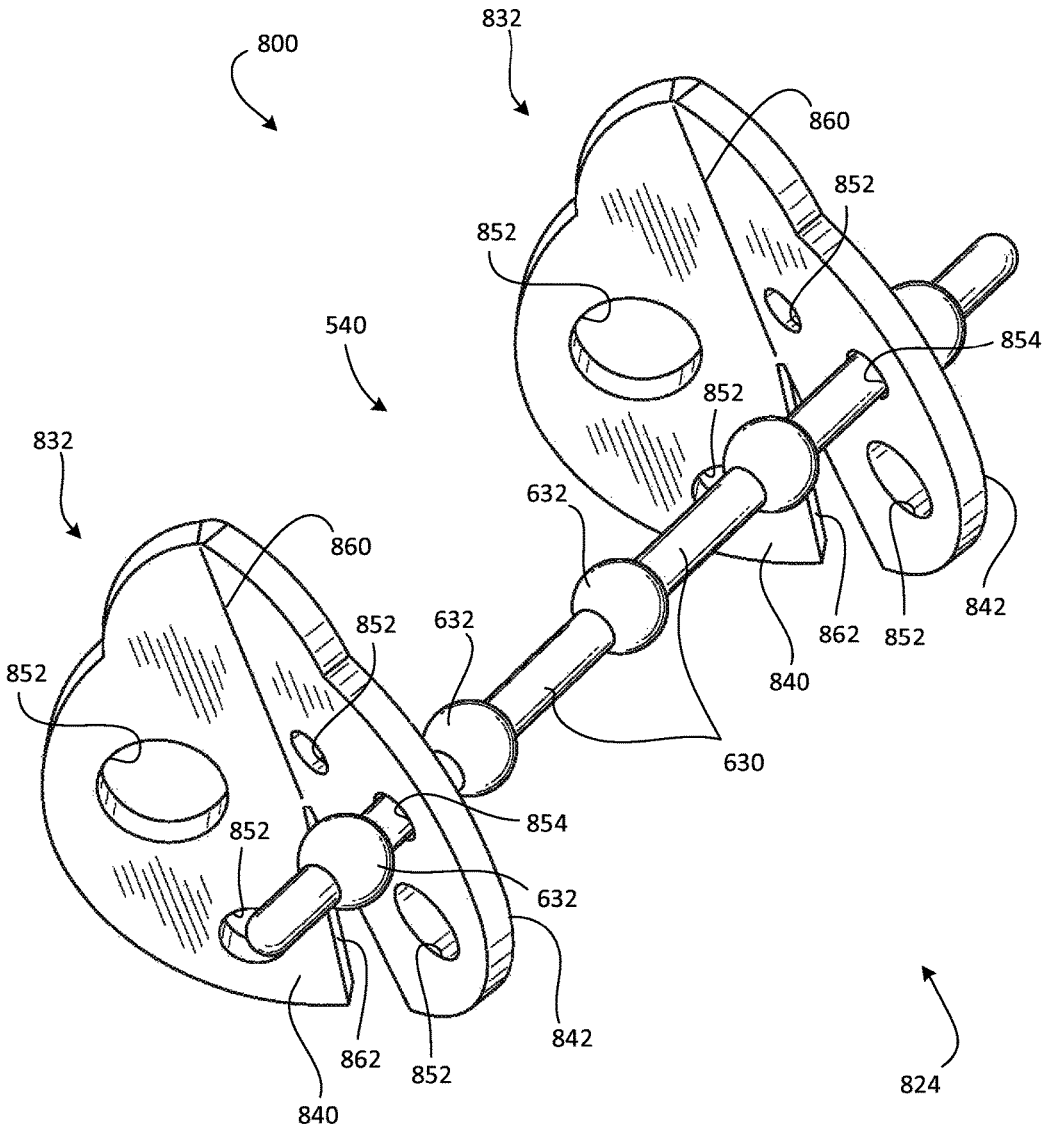
FIG. 8 is a perspective view of a mixing system according to yet another alternative embodiment.

FIG. 8 is a perspective view of a mixing system 800 according to yet another alternative embodiment. The mixing system 800 may be used in a manner similar to that of the mixing system 500, and may also be used on conjunction with a wide variety of containers. The mixing system 800 may have a mixing component 824 with a shaft 540 like that of the mixing system 500, and a plurality of mixing members 832.

Each of the mixing members 832 may have a first mixing surface 840 and a second mixing surface 842 positioned on the opposite side of the mixing member 832 from the first mixing surface 840. The first mixing surface 840 and the second mixing surface 842 may have a shape different from the bumblebee shape of FIG. 6 and the butterfly shape of FIG. 7. Specifically, the first mixing surface 840 and the second mixing surface 842 may each have an ornamental ladybug shape. Again, the various protrusions and edges of the shape may facilitate mixture of the ingredients together.

Each of the mixing members 832 may have a plurality of primary windows 852 and a shaft retention window 854. Each of the primary windows 752 may have a generally circular shape. However, the primary windows 752 of each mixing member 832 may be of various sizes. The variation in sizes may help the mixing component 824 to effectively mix ingredients including solids of a variety of sizes. The shaft retention windows 854 may be sized, relative to the narrow segments 630 and the enlarged portions 632 of the shaft 540, in a manner that retains the mixing members 832 on the shaft 540, while still allowing relatively easy assembly and disassembly of the mixing component 824.

Each of the mixing members 832 may have a central portion that is not crossed by any window, but instead has a central fold 860. The central fold 860 may include any of a variety of angles, including but not limited to those set forth in the description of the central fold 760 of the mixing members 732 of the previous embodiment. The central fold 860 may make it easier to maintain the surface area of the mixing members 832, while enabling the mixing members to fit through an opening of a specific size, such as the narrow neck of a baby bottle such as the container 510 of FIG. 5. Further, as in the previous embodiment, the mixing members 832 may function independently of any bridging members that span the primary windows 852 or the shaft retention windows 854.

Further, each of the mixing members 832 may have a notch 862 positioned on the central fold 860. The notch 862 may serve to add additional surfaces, edges, and/or surface area in contact with the ingredients, thereby facilitating mixture of the ingredients together.

FIGS. 5 through 8 illustrate mixing systems in which similar mixing members are used. However, in alternative embodiments (not shown), a mixing system may have two or more mixing members with dissimilar shapes, materials, and/or the like. Such variety may facilitate usage of a single mixing system to mix multiple different combinations of ingredients, and may allow the users to enjoy some variety. In some examples, a coupling such as the shaft 540 may be packaged together with a variety of mixing members, such as the mixing members 542 of FIG. 6, the mixing members 732 of FIG. 7, and the mixing members 832 of FIG. 8. The user may select a desired combination of mixing members (for ornamental or other reasons) and then snap them onto the shaft 540 in the desired arrangement.

Referring again to the mixing system 100 of FIGS. 1 through 4, the mixing members 142 may be retained and/or actuated in various ways, different from those set forth in FIGS. 1 through 4. For example, the mixing members 142 may be secured to a shaft, and the shaft may be urged to rotate within the container. Alternatively, the mixing members 142 may be rotatably coupled to the shaft, but the shaft may have a non-circular cross-sectional shape with different container engagement components. Examples of these embodiments will be shown and described in connection with FIGS. 9 through 11, as follows.

Figure 9:
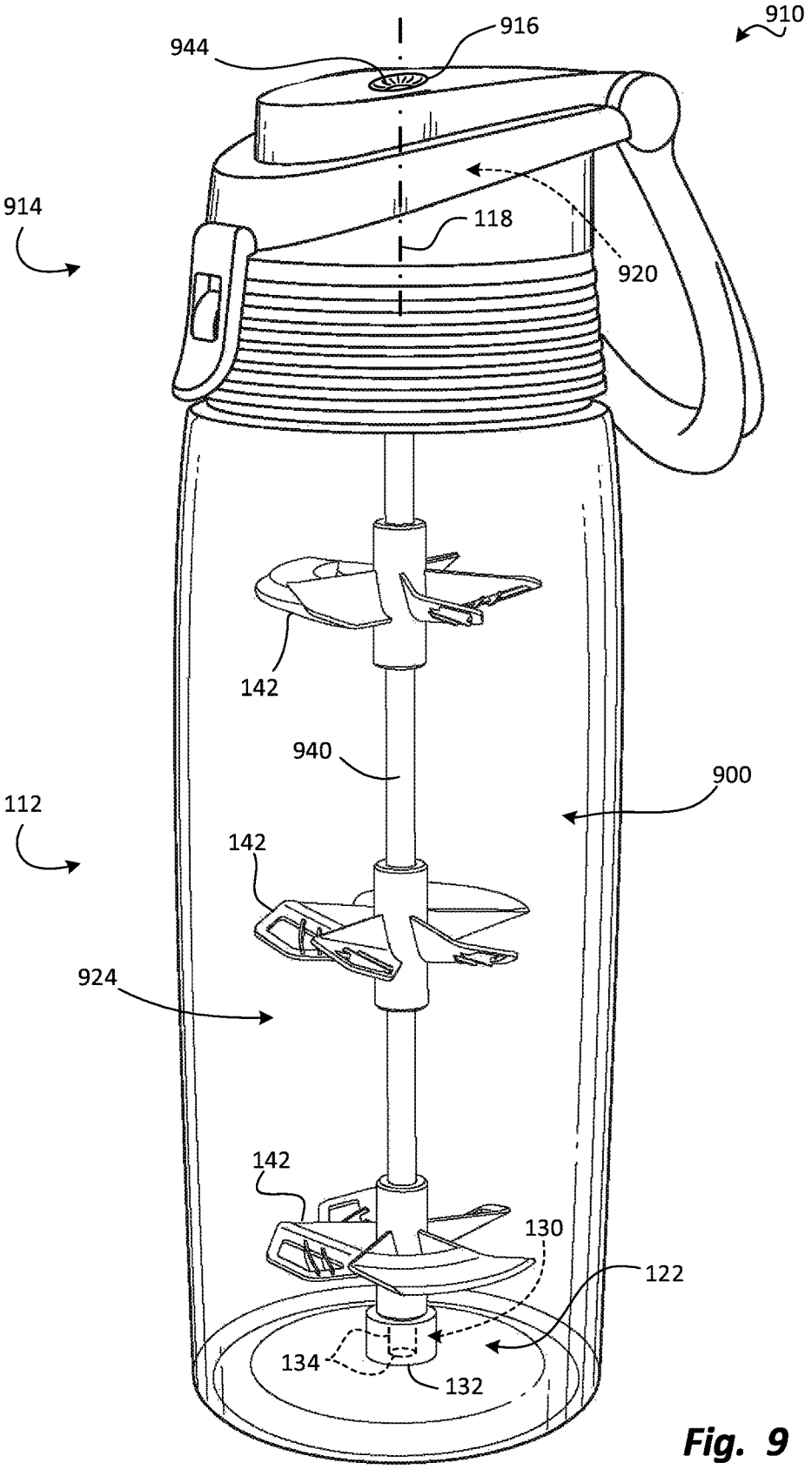
FIG. 9 is a perspective view of a mixing system positioned within a container, according to still another alternative embodiment.

Referring to FIG. 9, a perspective view illustrates a mixing system 900 positioned within a container 910, according to still another alternative embodiment. Components of the mixing system 900 and container 910 with the same numbers as those of the mixing system 100 and container 110 of FIGS. 1 through 4 may similar or identical to their counterparts of FIGS. 1 through 4.

The container 910 may have a bottle portion 112 like that of FIGS. 1 through 4, and a cap portion 914 that facilitates manual actuation of the mixing system 900. Specifically, the cap portion 914 may have an actuation aperture 916 aligned with the axis 118 of the container 910. The actuation aperture 916 may be sized such that the tip of a digit (a finger or thumb) of the user can be inserted through the actuation aperture 916 and used to actuate the mixing system 900, as will be set forth below.

As shown, the mixing system 900 may have a first container engagement component 920 (not visible in FIG. 9), a second container engagement component 122, and a mixing component 924. The mixing component 924 may have a shaft 940 and a plurality of mixing members 142 that are rigidly attached to the shaft 940. The shaft 940 may be rotatably coupled to the container 910 via the first container engagement component 920 and the second container engagement component 122.

An actuation interface 944 may be secured to the end of the shaft 940, and may be positioned adjacent to the actuation aperture 916. The actuation interface 944 may be recessed within the profile of the cap portion 914, or may be flush with the profile of the cap portion 914, so that the actuation interface 944 does not protrude from the cap portion 914. As embodied in FIG. 9, the actuation interface 944 may have the shape of a concave dome that extends into the interior of the cap portion 914, and provides ready contact with a sizable surface area of the user's digit when the digit is inserted into the actuation aperture 916.

Thus, the user can easily insert the tip of a thumb or finger through the actuation aperture 916 and into contact with the actuation interface 944. The user may then rotate the thumb or finger about the axis 118 to induce rotation of the mixing component 924 about the axis 118. Since the mixing members 142 are fixedly attached to the shaft 940, rotation of the actuation interface 944 may cause rotation of the shaft 940, thereby causing rotation of the mixing members 142 about the axis 118.

The second container engagement component 122 may have the same configuration as that of FIGS. 1 through 4. However, the first container engagement component 920 may have a different configuration. More particularly, the first container engagement component 920 may be shaped to rotatably retain the upper end of the shaft 940 such that the upper end of the shaft 940 passes through the first container engagement component 920, leaving the actuation interface 944 exposed.

In alternative embodiments, various actuation interfaces may be used. Such actuation interfaces may be shaped differently from the concave shape of the actuation interface 944 of FIG. 9. In some embodiments, an actuation interface may protrude from the container for easier and/or different access and/or actuation. Further, in some embodiments, the mixing members 142 may be slidably, but not rotatably, coupled to the shaft 940. For example, the mixing members 142 may be able to slide along the shaft 940, but may not be capable of rotating relative to it. Such a coupling may be obtained through the use of a splined interface or the like.

Figure 10:
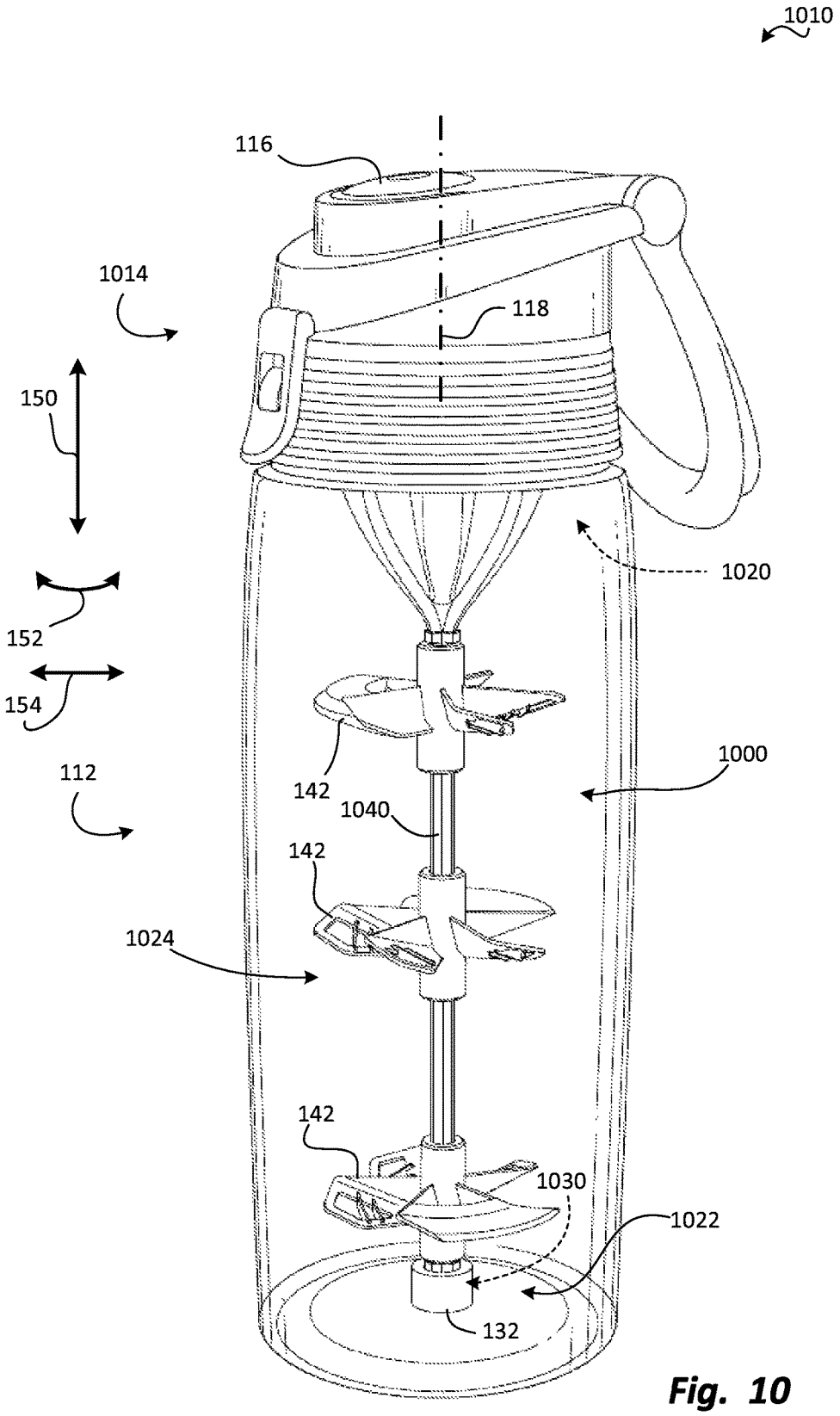
FIG. 10 is a perspective view of a mixing system positioned within a container according to yet another alternative embodiment.

Referring to FIG. 10, a perspective view illustrates a mixing system 1000 positioned within a container 1010 according to yet another alternative embodiment. Components of the mixing system 1000 and container 1010 with the same numbers as those of the mixing system 100 and container 110 of FIGS. 1 through 4 may similar or identical to their counterparts of FIGS. 1 through 4.

The mixing system 1000 may be retained within the container 1010 in a manner different from those of the mixing system 100 of FIGS. 1 through 4 and the mixing system 900 of FIG. 9. As shown, the container 1010 may have a bottle portion 112 and a cap portion 1014. The mixing system 1000 may have a first container engagement component 1020 (not visible in FIG. 10), a second container engagement component 1022, and a mixing component 1024.

The mixing component 1024 may have a shaft 1040 and a plurality of mixing members 142 that are rotatably and slidably attached to the shaft 1040, like the mixing members 142 of the mixing system 100 of FIGS. 1 through 4. Thus, like the mixing system 100 of FIGS. 1 through 4, the mixing system 1000 may be designed such that the mixing members 142 slide and/or rotate along the shaft 1040 in response to repetitive motion of the container 1010. This repetitive motion may be in the direction indicated by the arrows 150, the arrows 152, and/or the arrows 154, as described in connection with FIG. 1.

The shaft 1040 may be secured to the container 1010 via the first container engagement component 1020 and the second container engagement component 1022. The shaft 1040 of the mixing component 1024 of the mixing system 1000 may have a splined cross-sectional shape. The splined cross-sectional shape may have a number of splines that are arranged in radially symmetrical fashion around the axis 118. In the exemplary embodiment shown in FIG. 10, the shaft 1040 may have three splines that protrude outward from the axis 118. The configuration of the shaft 1040 will be shown in greater detail in FIG. 11.

The splined cross-sectional shape may provide a reduced-friction interface with the mixing members 142, thereby facilitating and/or expediting relative rotation and/or sliding motion between the mixing members 142 and the shaft 1040. The resulting enhanced motion of the mixing members 142 may facilitate and/or expedite mixture of the ingredients within the container 1010.

The second container engagement component 1022 may have a configuration similar to that of the second container engagement component 122. A tubular receiver 132 on the bottle portion 112 may receive a boss 1030 at the lower end of the shaft 1040. However, unlike the cylindrical bosses 130 of the shaft 140 of the mixing system 100 of FIGS. 1 through 4, the boss 1030 may have a splined shape similar to that of the cross-sectional shape of the shaft 1040. The boss 1030 may, for example, have a similar, but enlarged cross-sectionals shape, with engagement surfaces 1034 (shown in FIG. 11) that engage the interior of the 132. The first container engagement component 1020 may be different from the first container engagement component 120 of the mixing system 100 of FIGS. 1 through 4, and may utilize a threaded connection to the cap portion 1014, as will be shown and described in connection with FIG. 11.

Figure 11:
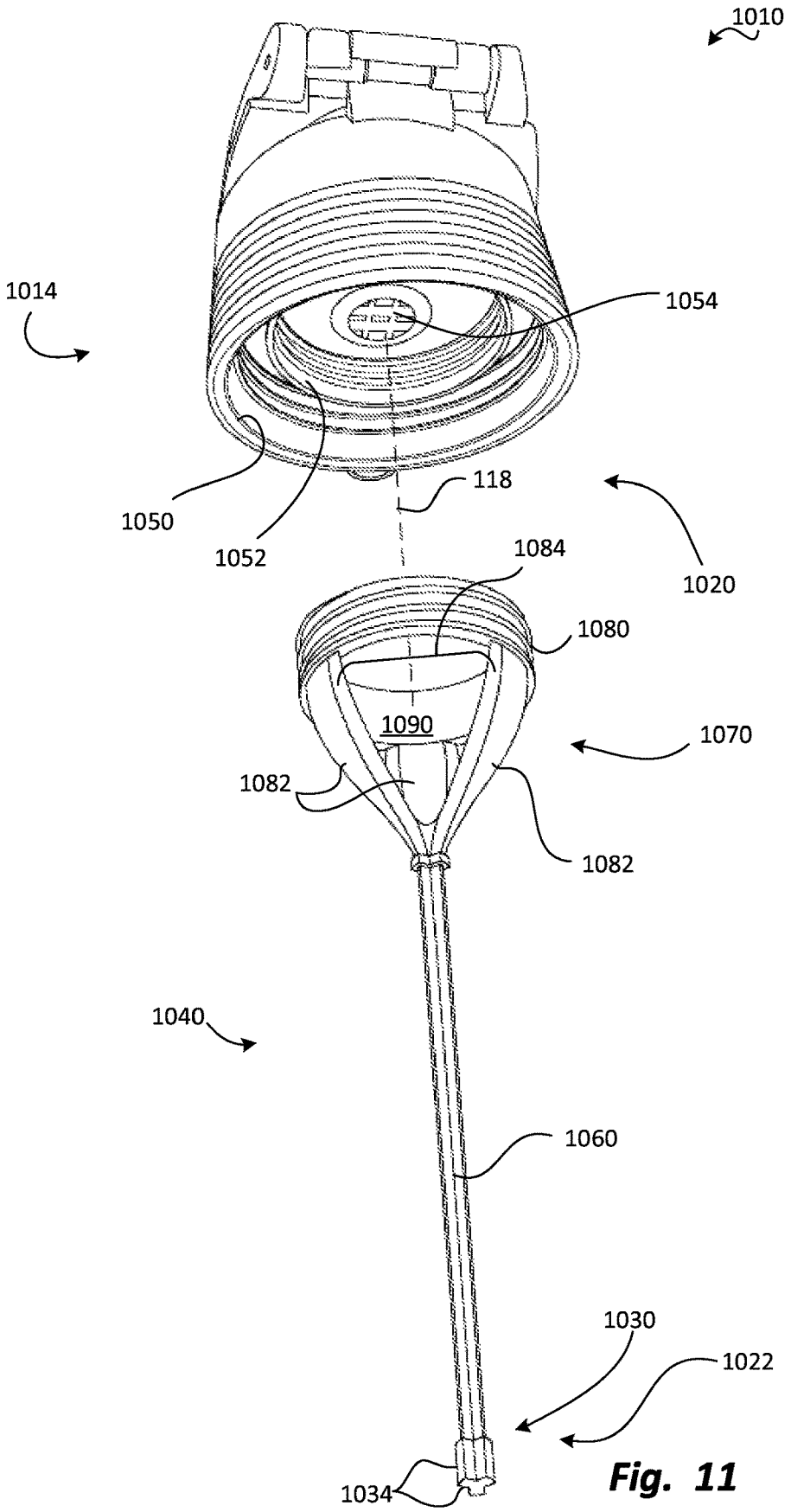
FIG. 11 is an exploded, perspective view of the shaft of the mixing system and the cap of the container of FIG. 10.

Referring to FIG. 11, an exploded, perspective view illustrates the shaft 1040 of the mixing system 1000 and the cap portion 1014 of the container 1010 of FIG. 10. As shown, the cap portion 1014 may have an outer rim 1050, an inner rim 1052, and an aperture 1054. The outer rim 1050 may be threaded on its interior to receive corresponding threads (not shown) on the neck portion of the bottle portion 112. The inner rim 1052 may also be threaded on its interior to permit the upper end of the shaft 1040 to be threaded into engagement with the inner rim 1052, and thence secured to the cap portion 1014. The aperture 1054 may permit the ingredients to flow into and/or out of the bottle portion 112 through the cap portion 1014.

The shaft 1040 may have a central portion 1060 and a flared upper end 1070 at which the diameter of the shaft 1040 expands relative to that of the central portion 1060. The flared upper end 1070 may have a rim 1080 and a plurality of arms 1082 that connect the rim 1080 to the central portion 1060. The arms 1082 may be spaced apart to leave gaps 1084 between the arms 1082, through which the ingredients can flow into an interior 1090 of the flared upper end 1070 from the remainder of the interior of the bottle portion 112, or from the interior 1090 of the flared upper end 1070 to the remainder of the interior of the bottle portion 112.

The rim 1080 may have exterior threads sized to engage the interior threads of the inner rim 1052 of the cap portion 1014. Thus, the shaft 1040 may be easily secured to the cap portion 1014 by rotating the shaft 1040 relative to the cap portion 1014 about the axis 118 with the rim 1080 of the shaft 1040 abutting the inner rim 1052, so that the exterior threads of the rim 1080 engage the interior threads of the inner rim 1052. The cap portion 1014 may then be threaded into engagement with the bottle portion 112 by rotating the cap portion 1014 and the shaft 1040 relative to the bottle portion 112 about the axis 118 with the outer rim 1050 abutting the neck portion of the bottle portion 112. This may cause the boss 1030 of the second container engagement component 1022 to seat in the tubular receiver 132 of the bottle portion 112. Thus, both ends of the shaft 1040 may be secured relative to the container 1010.

The shaft 1040 may optionally be inserted through the inner rims 310 of the mixing members 142 prior to attachment of the shaft 1040 to the cap portion 1014. If desired, the boss 1030 may optionally be made as a separate piece from the central portion 1060 of the shaft 1040. The boss 1030 may be detachably or permanently secured to the lower end of the central portion 1060 after insertion of the mixing members 142 onto the central portion 1060 so that the boss 1030 then acts to retain the mixing members 142 on the central portion 1060.

The operation of the mixing system 1000 may then be similar to that of the mixing system 100, as described in connection with FIGS. 1 through 4. The user may agitate, shake, and/or otherwise repetitively move the container 1010 in the direction of the arrows 150, the arrows 152, and/or the arrows 154 to cause the mixing members 142 to rotate about the axis 118 and/or slide along the axis 118. This motion of the mixing members 142 may cause the various mixing surfaces of the mixing members 142 to contact the ingredients within the bottle portion 112 of the container 1010, thereby facilitating mixing. Mixed ingredients may be imbibed or poured from the container 1010 by opening the drinking aperture 116 of the cap portion 1014 and tipping the container 1010 so that the ingredients flow into the interior 1090 of the upper end 1070 from the remainder of the interior space within the bottle portion 112 of the container 1010. The ingredients may then flow from the interior 1090 through the aperture 1054 and out of the cap portion 1014 through the drinking aperture 116.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, Figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements recited in means-plus-function format are intended to be construed in accordance with 35 U.S.C. § 112 Para. 6. It will be apparent to those having skill in the art that changes may be made to the details of the above-described embodiments without departing from the underlying principles of the invention.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A system comprising:

a container comprising:

a bottle portion; and a cap portion comprising a nipple that facilitates feeding ingredients within the bottle portion to an infant; and a mixing component positionable entirely within the bottle portion to mix the ingredients, the mixing component comprising:

a shaft completely decoupled from the bottle portion and the cap portion; and a plurality of mixing members arranged along and coupled to the shaft;

wherein each of the mixing members is shaped to define a plurality of mixing surfaces comprising:

a first mixing surface; and a second mixing surface, wherein the second mixing surface is on an opposite side of the mixing member from the first mixing surface;

wherein each of the mixing members is shaped to define a plurality of windows that extend between the first and second mixing surfaces to permit passage of the ingredients there through between the first and second mixing surfaces;

wherein, in response to repetitive motion of the container with the mixing component disposed within the container, the mixing surfaces contact the ingredients in a manner that promotes mixture of the ingredients together.

2. The system of claim 1, wherein the shaft is formed of a material selected to permit significant flexure of the shaft.

3. The system of claim 1, wherein each of the mixing members is loosely coupled to the shaft.

4. The system of claim 1, wherein, for each of the mixing members:

the first mixing surface is generally planar and is oriented nonparallel to the shaft;

the second mixing surface is generally planar and is oriented nonparallel to the shaft;

each of the windows is generally planar; and at least one of the windows is displaced from the shaft.

5. The system of claim 1, wherein, for each of the mixing members, the plurality of windows comprises a shaft retention window sized to receive the shaft.

6. The system of claim 5, wherein the shaft comprises:

a plurality of enlarged portions that are spaced apart from each other; and a plurality of narrow segments that are narrower than the enlarged portions, wherein each of the narrow segments extends between two of the enlarged portions;

wherein the shaft retention window is larger than the narrow segments and smaller than the enlarged portions.

7. The system of claim 6, wherein the shaft retention window and the enlarged portions are dimensioned such that, in response to manual application of force urging one of the enlarged portions through the shaft retention window, the one of the enlarged portions snaps through the shaft retention window.

8. The system of claim 5, wherein, for each of the mixing members, the plurality of windows further comprises:

a primary window; and a secondary window smaller than the primary window.

9. The system of claim 1, wherein each of the mixing members comprises a substantially uniform thickness between the first mixing surface and the second mixing surface.

10. The system of claim 9, wherein the plurality of windows comprises a primary window, wherein each of the mixing members further comprises a plurality of bridging members that span the primary window, wherein each of the bridging members comprises at least one bridging member mixing surface of the plurality of mixing surfaces; wherein the bridging member mixing surfaces facilitate mixture together of ingredients flowing through the primary window.

11. The system of claim 10, wherein each of the bridging members comprises an elongated shape such that the bridging members define, within the primary window, a plurality of elongated slots bounded by the mixing surfaces.

12. The system of claim 9, wherein the first mixing surface comprises a first portion and a second portion, each of which is substantially planar.

13. The system of claim 12, wherein the first portion is separated from the second portion by a central fold that positions the first portion nonparallel to the second portion.

14. A system comprising:

a container comprising:

a bottle portion; and a cap portion comprising a nipple that facilitates feeding ingredients within the bottle portion to an infant; and a mixing component positionable within an interior of a container to mix ingredients within the container, the mixing component comprising:

a shaft positionable entirely within the bottle portion and completely decoupled from the bottle portion and the cap portion, the shaft comprising:

a plurality of enlarged portions that are spaced apart from each other; and a plurality of narrow segments that are narrower than the enlarged portions, wherein each of the narrow segments extends between two of the enlarged portions; and a plurality of mixing members arranged along and coupled to the shaft;

wherein each of the mixing members is shaped to define a plurality of mixing surfaces comprising:

a first mixing surface; and a second mixing surface, wherein the second mixing surface is on an opposite side of the mixing member from the first mixing surface;

wherein:

each of the mixing members is shaped to define a plurality of windows that extend between the first and second mixing surfaces to permit passage of the ingredients there through between the first and second mixing surfaces;

for each of the mixing members, the plurality of windows comprises a shaft retention window sized to receive the shaft;

the shaft retention window and the enlarged portions are dimensioned such that, in response to manual application of force urging one of the enlarged portions through the shaft retention window, the one of the enlarged portions snaps through the shaft retention window;

each of the mixing members comprises a substantially uniform thickness between the first mixing surface and the second mixing surface;

the first mixing surface comprises a first portion and a second portion, each of which is substantially planar; and the mixing surfaces are positioned such that, in response to repetitive motion of the container with the mixing component disposed within the container, the mixing surfaces contact the ingredients in a manner that promotes mixture of the ingredients together.

* * * * *